US007308892B2

(12) United States Patent
Cockerell

(10) Patent No.: US 7,308,892 B2
(45) Date of Patent: Dec. 18, 2007

(54) METHOD AND APPARATUS FOR FORMING CRACKS IN CONCRETE

(75) Inventor: Allan David Cockerell, Brisbane (AU)

(73) Assignee: Concrete Slab Technology Pty Ltd, Brisbane, Queensland (AU)

( * ) Notice: Subject to any disclaimer, the term of this patent is extended or adjusted under 35 U.S.C. 154(b) by 29 days.

(21) Appl. No.: 10/568,945

(22) PCT Filed: Jul. 4, 2005

(86) PCT No.: PCT/AU2005/000986

§ 371 (c)(1),
(2), (4) Date: Feb. 22, 2006

(87) PCT Pub. No.: WO2006/002486

PCT Pub. Date: Jan. 12, 2006

(65) Prior Publication Data

US 2006/0272272 A1 Dec. 7, 2006

(30) Foreign Application Priority Data

Jul. 5, 2004 (AU) ..... 2004903639

(51) Int. Cl.
*B28D 1/32* (2006.01)

(52) U.S. Cl. ..... 125/23.01; 125/40

(58) Field of Classification Search ..... 125/13.01, 125/23.01, 23.02, 24, 40, 1
See application file for complete search history.

(56) References Cited

U.S. PATENT DOCUMENTS 5,857,302 A * 1/1999 Lill ..... 52/514.5
5,918,428 A * 7/1999 Hough ..... 52/127.3
6,203,112 B1 * 3/2001 Cook et al. ..... 299/39.3
2004/0025858 A1 * 2/2004 Barenberg et al. ..... 125/1

FOREIGN PATENT DOCUMENTS

| | | |
|---|---|---|
| DE | 2815744 | 8/1979 |
| DE | 3743643 A | 7/1989 |
| DE | 3837102 A | 5/1990 |
| EP | 294267 B | 8/1994 |

(Continued)

OTHER PUBLICATIONS

"New Technologies for Concrete Pavement Construction", Dirch H. Bager, Ph.D. and Peter Krarup, BSc., pp. 47-59.

*Primary Examiner*—Dung Van Nguyen
(74) *Attorney, Agent, or Firm*—Hoffman, Wasson & Gitler

(57) ABSTRACT

A method of forming at least one crack (11) in a concrete article such as a concrete slab (10) having at least one crack promoting groove (28) formed in the surface (25) thereof and/or at least one crack promoting insert (12) cast within the concrete slab (10) and substantially aligned with the groove (28) where used, the method comprising the steps of positioning a tool (24) having a force applying member (26) on or above the surface (25) of the concrete slab (10) such that the member (26) is positioned adjacent to or above a groove (28) and/or insert (12) and causing the tool (24) to apply through the member (26) a force to the concrete slab (10) to promote the formation of a crack or cracks (11) in the slab (10) along a groove (28) and/or insert (12). Apparatus for forming a crack in a concrete article is also disclosed.

39 Claims, 10 Drawing Sheets

FOREIGN PATENT DOCUMENTS

| | | | |
|---|---|---|---|
| JP | 08-103908 | A | 4/1996 |
| JP | 2001-081714 | A | 3/2001 |
| WO | WO 01/38242 | A | 5/2001 |
| WO | WO 02/02289 | A | 1/2002 |
| WO | WO 02/12630 | A | 2/2002 |

* cited by examiner

METHOD AND APPARATUS FOR FORMING CRACKS IN CONCRETE

TECHNICAL FIELD

This invention relates to forming cracks in concrete. In particular, the invention relates to a method of, and apparatus for, forming stress-relieving cracks in concrete paths, slabs or pavements.

BACKGROUND ART

With a single pour for a concrete path, slab or pavement, joints are installed at intervals in an effort to have the joints crack and thereby accommodate subsequent concrete shrinkage/expansion either side of the joint. One way in which such joints are provided is by forming crack promoting grooves in the exposed top surface of the concrete. These grooves can be formed in the concrete with tools or inserts as part of the concrete finishing process or they can be formed by concrete saw-cutting after the concrete finishing process. These grooves provide lines of weakness along which cracks can develop during the life of the concrete path, slab or pavement. Another way in which such joints are provided is by casting in a crack promoting insert during concrete placement. These crack promoting inserts positioned prior to concrete placement provide lines of weakness along which cracks can develop during the life of the concrete path, slab or pavement. Crack promoting inserts can be used in a joint in combination with a crack promoting groove. Usually, in such cases, the insert is immediately below the groove although the insert may be below and to one side of the groove if desired.

The time taken for a crack promoting groove or insert alone or in combination to create a crack depends on a range of variables including friction developed between the underside of the concrete path, slab or pavement and the supporting sub-grade, rate of concrete tensile strength development in the concrete, ambient temperature changes, rate of drying shrinkage of the concrete etc. Some crack promoting grooves and inserts never create a crack. Ideally all crack promoting grooves and inserts alone or in combination would create cracks immediately after completion of construction of the concrete path, slab or pavement. Then each crack created by a groove or insert would accommodate only the concrete shrinkage/expansion either side of that groove or insert.

In practice, both crack promoting grooves and inserts alone or in combination create cracks at varying times after completion of construction of the concrete path, slab or pavement and sometimes no crack is created. When cracks are created at varying times the crack promoting groove or insert that creates a crack first must accommodate all the concrete shrinkage/expansion of the concrete until another crack promoting groove or insert creates a crack. This results in joints with crack promoting grooves or inserts that create cracks early opening wider than those with crack promoting grooves or inserts that create cracks later. Cracked joints that open too wide are undesirable as they typically perform poorly during the life of the concrete path, slab or pavement.

Crack promoting grooves that are formed by concrete saw-cutting are often cut deep in an effort to promote cracking. This is expensive and the deep saw-cut reduces the ability of the cracked joint to transfer shear loads across the joint using aggregate interlock of the cracked concrete on each side of the cracked joint.

SUMMARY OF THE INVENTION

It is an object of the present invention to provide a method of forming cracks in concrete articles which at least minimises the disadvantages referred to above. It is a further object to provide apparatus for forming cracks in concrete articles.

The present invention will be described by way of example with reference to forming cracks in concrete paths, slabs or pavements. It should be appreciated that this description is given by way of example only and that the method of the invention may be used for other purposes also. The method of the invention may be used for allowing concrete articles to be cut into two or more pieces and may also be used for promoting cracks in concrete articles other than paths, slabs or pavements.

According to one aspect of the invention there is provided a method of forming at least one crack in a concrete article having at least one crack promoting groove formed in an upper surface thereof, said method comprising the steps of:

positioning a tool on or above said surface and in or adjacent a said crack promoting groove, said tool having a force applying member; and causing said tool to apply through said member a force to said concrete article to promote the formation of a crack in said concrete article along a said groove.

The force applying member suitably comprises an elongated member.

Where the length of the member is less than the length of a groove, the method of the invention suitably includes the step of progressively moving the tool to different locations longitudinally of the groove and applying a force through the member to the concrete article at each location.

The member may be of a configuration such that it may be received within the groove in which case the step of progressively moving the tool to different locations includes the step of progressively moving the member such that it is located within or may be received within the groove.

Alternatively, the member may be positioned adjacent to or above the groove for application of the force to the concrete article.

Suitably the concrete article has a plurality of crack promoting grooves in its upper surface typically arranged in a grid and the method comprises the step of causing the force applying member to apply forces to the concrete article to promote the formation of a plurality of cracks in the concrete article along the grooves in the grid.

According to another aspect of the invention there is provided a method of forming at least one crack in a concrete article having at least one crack promoting insert cast within the concrete article, said method comprising the steps of:

positioning a tool having a force applying member on or above the surface of the concrete article whereby said member is located adjacent to or above an insert, and causing said tool to apply through said member a force to said concrete article to promote the formation of a crack in said concrete article along said insert.

The force applying member suitably comprises an elongated member.

Where the length of the force applying member is less than the length of an insert, the method of the invention suitably includes the step of progressively moving the tool to different locations longitudinally of the insert and applying a force through the member to the concrete article at each location.

The concrete article is suitably provided with a plurality of crack promoting inserts typically arranged in a grid and the method comprises the step of causing the force applying member to apply a force or forces to the concrete article to promote the formation of a plurality of cracks in the concrete article along the inserts in the grid.

According to yet another aspect of the invention there is provided a method of forming at least one crack in a concrete article having at least one crack promoting groove formed in the upper surface thereof and at least one crack promoting insert cast within the concrete article substantially aligned with said at least one groove, said method including the steps of:

positioning a tool having a force applying member on or above the surface of the concrete article such that said member is adjacent to or above a groove and insert, and causing said tool to apply through said member a force to said concrete article to promote the formation of a crack in said concrete article along said insert and between said insert and an aligned groove.

The insert is suitably positioned immediately below a groove however the insert may be below and to one side of a groove.

Where the length of the member is less than the length of the groove and/or insert, the method of the invention suitably includes the step of progressively moving the tool to different locations along the groove and/or insert and applying a force through the member to the concrete article at each location.

The member may be of a configuration such that it may be received within the groove in which case the step of progressively moving the tool to different locations includes the step of progressively moving the member such that it is located within or may be received within the groove.

Alternatively, the member may be positioned adjacent to or above the groove for application of the force to the concrete article.

The concrete article may have a grid of crack promoting grooves formed in an upper surface thereof and a grid of crack promoting inserts cast within the concrete article, respective crack promoting grooves in the grid of grooves being substantially aligned with respective crack promoting inserts of the grid of inserts. The method of the invention in this aspect comprises the step of causing the force applying member to apply a force or forces to the concrete article to promote the formation of a plurality of cracks in the concrete article along the inserts in the grid and between the inserts and substantially aligned grooves.

The force applying member for use in the above methods may comprise an elongated planar contact surface. Alternatively the member may comprise an elongated edge or blade-like member such that the member is in the form of a bolster. Where the impact member comprises a planar contact surface, the surface suitably is provided with a strip of rubber or other resilient or cushioning material to accommodate irregularities in the slab surface and protect the concrete surface. Where the member is in the form of a bolster or blade, it may be positioned within the groove or adjacent to a groove.

The concrete article may comprise a concrete path, slab or pavement with reinforcing such as reinforcing fibres, mesh or rods. Alternatively, the concrete article may comprise a concrete path, slab or pavement without reinforcing.

The tool for use in the above methods suitably comprises an impact tool in which case the force applying member comprises an impact applying member for applying an impact force to the concrete article. In an alternative arrangement, the tool may comprise a vibratory tool in which case the force applying member may comprise a member for applying a vibratory force to the concrete article.

Applying an impact to the concrete article may involve resting the impact member against the article and then applying an impact to the impact member such as by striking the impact member with a hammer or other apparatus which is suitable for this purpose. In another aspect, the impact member may be struck directly against the article.

A mechanical, pneumatic or hydraulic drive may be associated with the impact member and be operated to apply an impact to the impact member or cause the impact member to strike the concrete article. The drive may comprise means to elevate and drop the impact member against the article. The drive may include means to elevate a weight and means to drop the weight onto the impact member. Alternatively the drive may be coupled to the impact member to cause an impact through the impact member to be applied to the article.

The vibratory tool may comprise a mechanical vibrator to apply a vibratory force to the concrete article.

A plurality of impact tools or impact members may be used, and positioned substantially adjacent to the groove or insert if utilized in the concrete article and means may be provided either to cause an impact to be applied to each impact member such as by striking the impact member with a hammer or other apparatus which is suitable for this purpose or by striking the impact members against the article to promote the formation of a crack along the groove and/or insert. The impact members may be caused to apply impact forces to the concrete article simultaneously such as by striking the impact members against the article simultaneously. Alternatively, the impact members may be caused to apply impacts to the article sequentially or at different times. For example, the impact members may strike the article sequentially.

Similarly a plurality of vibrators may be provided to apply vibratory forces to the concrete article either simultaneously or sequentially.

Where the concrete article is provided with crack promoting grooves, the grooves in the concrete article may be grooves that are formed in the article during the concrete finishing process for example by the use of an elongated moulding member which may be removable from the upper surface of the concrete after the concrete hardens or cures or an elongated moulding member cast in the finished surface of the concrete. Alternatively, grooves may be cut in the concrete after the concrete finishing process.

Where the concrete article is provided with an insert or inserts, the insert or inserts in the concrete article may be cast in the article during concrete placement. The insert may have any suitable shape or size. Preferably, the insert is "T" shaped and is placed in an inverted orientation below the groove if used such that the base flange of the "T" sits on the ground or base surface and the leg of the "T" is upstanding. The crack promoting inserts positioned prior to concrete placement provide lines of weakness along which cracks can propagate.

The inserts typically are arranged at right angles to each other and may be formed such that crossing inserts can interlock. For this purpose the leg of a lowermost insert is provided with a slot in its leg to receive the leg of the uppermost insert and the base flange of the uppermost insert is provided with slots to receive the leg of the lowermost insert.

Alternatively or additionally, connectors may be provided to interconnect inserts which extend at right angles to each other. The connectors may include four limbs each extending at right angles to an adjacent limb and restraining means suitably associated with each limb to restrain the base flange of an insert to a limb.

In another aspect, the present invention provides apparatus for forming at least one crack in a concrete article provided with at least one crack promoting groove and/or at least one crack promoting insert, said apparatus including a chassis, said chassis supporting tool having a force applying member, and means for causing said tool to apply through said member a force to said concrete article to promote the formation of at least one crack in said concrete article along a crack promoting groove and/or along a crack promoting insert.

Preferably the chassis comprises a mobile chassis which may be moved to move the tool to different positions on or above the concrete article. The chassis may be supported by at least one pair of steerable wheels to enable the chassis to be steered to different positions on the concrete article. In a particularly preferred form, the chassis may be supported by two pairs of steerable wheels suitably arranged at opposite ends of the chassis. The steerable wheels suitably may be such as to allow the chassis to be moved laterally so that the tool can be repositioned to a side of a previously formed crack in the concrete article. Thus where the concrete article is provided with a grid of crack promoting grooves, the chassis can be moved from a position aligned with one crack promoting groove to a position on one side of the one crack promoting groove for alignment with a further crack promoting groove. Similarly where the concrete article is provided with a grid of crack promoting inserts, the chassis can be moved from a position aligned with one crack promoting insert to a position on one side of the one crack promoting insert where it is aligned with a further crack promoting insert. The chassis may also be steered to a position from alignment with one crack promoting insert or groove to a position in alignment with an orthogonally extending crack promoting groove or insert.

Preferably the tool comprises an impact tool having a contact member comprising the force applying member for applying a force to the concrete article. The contact member suitably comprises a contact beam and means are provided to apply an impact to the contact beam. The contact beam is suitably supported for movement between a first position where it is elevated above the surface of a concrete article to a second position where it is in contact with the surface of the concrete article. The contact beam suitably extends longitudinally of the chassis. The contact beam is suitably arranged centrally of the chassis however it may be selectively adjusted laterally of the chassis for accurate positioning. In an alternative configuration, the contact beam may extend transversely of the chassis for example normal to the longitudinal axis of the chassis.

Preferably the chassis supports guides for guiding the contact beam between its first and second positions. The guides suitably guide the contact beam for movement in substantial parallelism. The guides suitably comprise spaced apart guides arranged at opposite ends of the chassis where the contact beam extends longitudinally of the chassis. Suitably elevating and lowering means are associated with each guide for elevating and lowering the contact beam. The elevating and lowering means suitably comprise hydraulic rams.

The means for applying an impact to the contact beam suitably comprises an impact beam, the impact beam suitably comprising a weighted member above the contact beam. Means are suitably provided for elevating the impact beam above the contact beam. Means are also suitably provided for releasing the impact beam from an elevated position to permit it to drop under the influence of gravity towards the contact beam to impact on the contact beam. Suitably the impact beam comprises an elongated beam extending substantially parallel to the contact beam. Means are suitably provided at opposite ends of the elongated impact beam for cooperation with the guides to guide the elongated impact beam towards and away from the contact beam. Such means suitably comprise rollers at opposite ends of the elongated impact beam. Cushioning means may be provided to cushion the impact between the impact beam and contact beam. The cushioning means may comprise a plurality of cushioning members or bumpers formed of a cushioning material.

The means for elevating the impact beam suitably comprise a vertically extendable member and the means for releasing the impact beam suitably comprise releasable latching means for latching the impact beam to the vertically extendable member. Thus when the latching means are released the impact beam will drop towards the contact beam.

The contact beam suitably includes a contact member for contact with the surface of the concrete article or slab. The contact member may comprise a planar member. The planar member may be provided with a strip of cushioning material such as rubber. Alternatively the contact member may comprise an elongated linear pointed or blade-like member.

Where the tool comprises a vibratory tool, it may be of similar configuration to the impact tool described above (apart from the impact beam). The vibratory tool may include a contact beam as above and a vibrator mounted to the contact beam.

Typically the mobile chassis is moved over the surface of a concrete path, slab or pavement under remote control. The mobile chassis may also be automatically guided such as by a laser guidance system to ensure accurate positioning of the apparatus for creation of the cracks. The laser guidance system may include means for establishing a laser plane offset from and parallel to a row of inserts or line of grooves and laser receivers on the apparatus aligned with a longitudinal axis of the apparatus.

BRIEF DESCRIPTION OF THE DRAWINGS

Reference will now be made to the accompanying drawings which illustrate preferred embodiments of the invention and wherein.

DETAILED DESCRIPTION OF THE PREFERRED EMBODIMENTS

Figure 1:
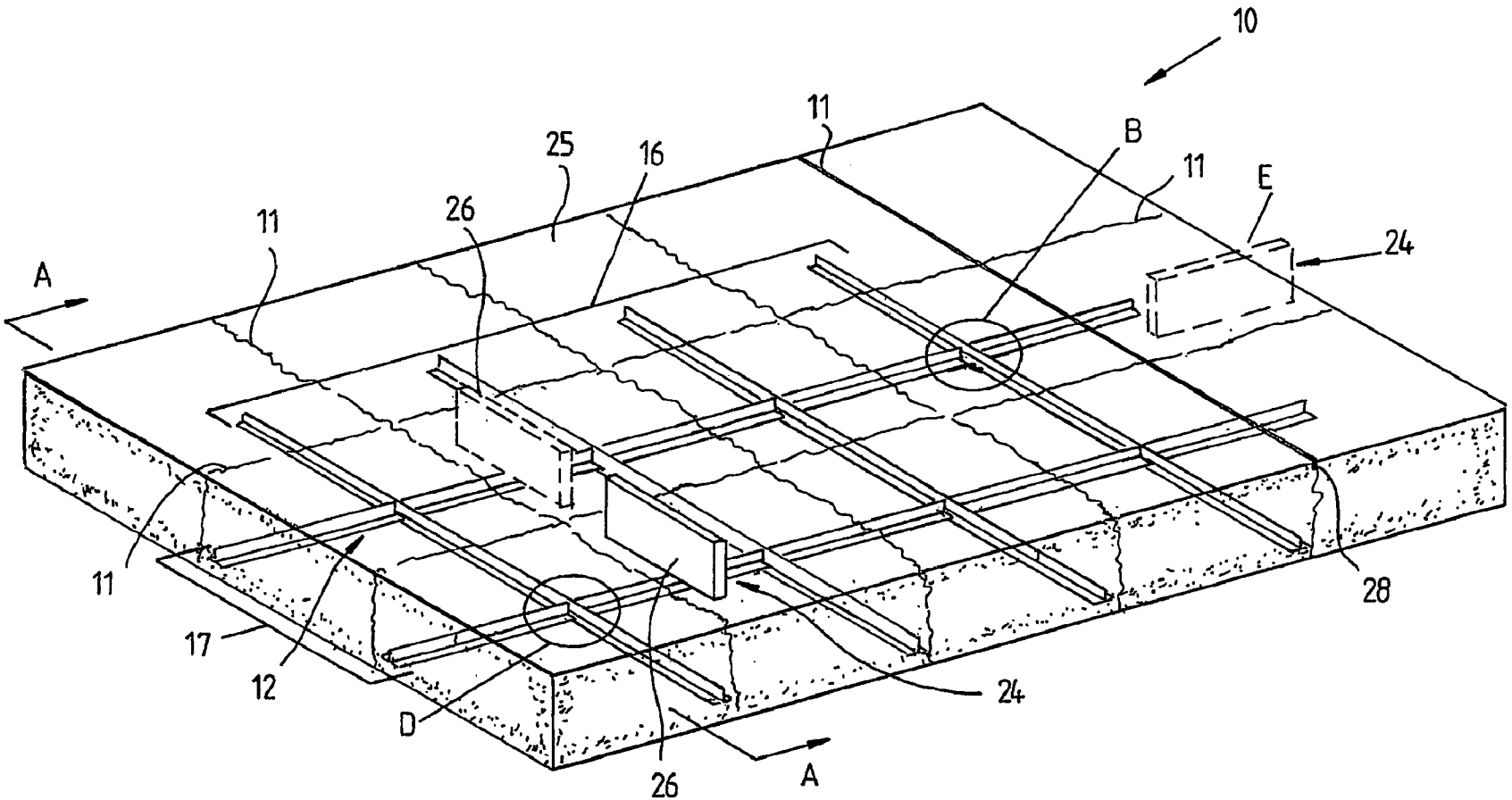
FIG. 1 is a perspective ghost view of a concrete slab in which cracks are formed in accordance with the present invention.
Figure 2:
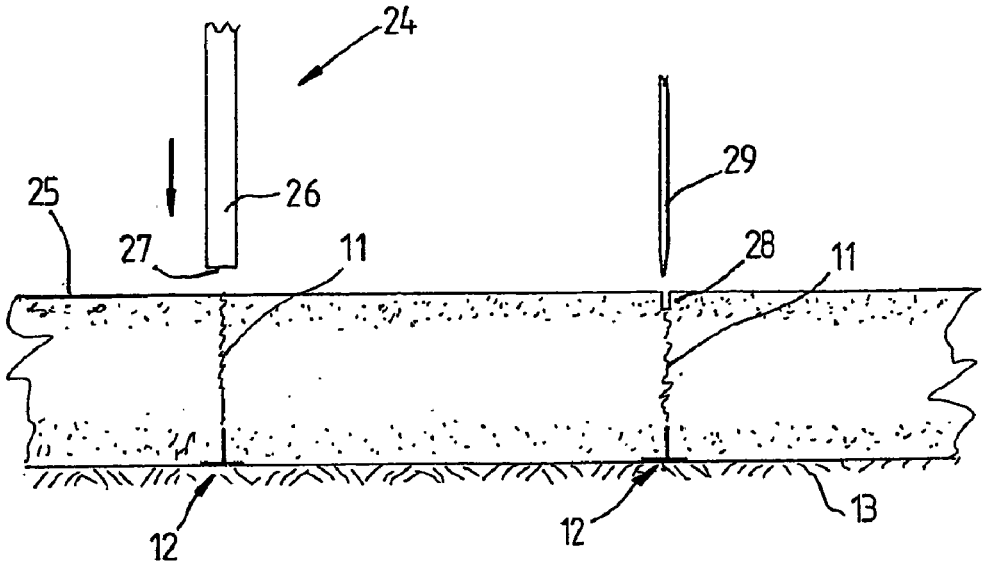
FIG. 2 is a sectional view of the concrete slab along line A-A of FIG. 1 showing different force applying members for forming the cracks in the concrete slab.

Referring to the drawings and firstly to FIGS. 1 and 2, there is illustrated a concrete slab 10 in which a series of cracks 11 are formed in accordance with the present invention, the cracks 11 corresponding to a rectangular array of linear crack promoting inserts 12 located in the slab 10 and which are installed in the slab 10 during the construction thereof. For this purpose, the ground surface 13 on which the slab 10 is to be constructed is levelled and the array of crack promoting inserts 12 installed on the surface 13 usually on a plastic membrane located on the surface 13.

Figure 3:
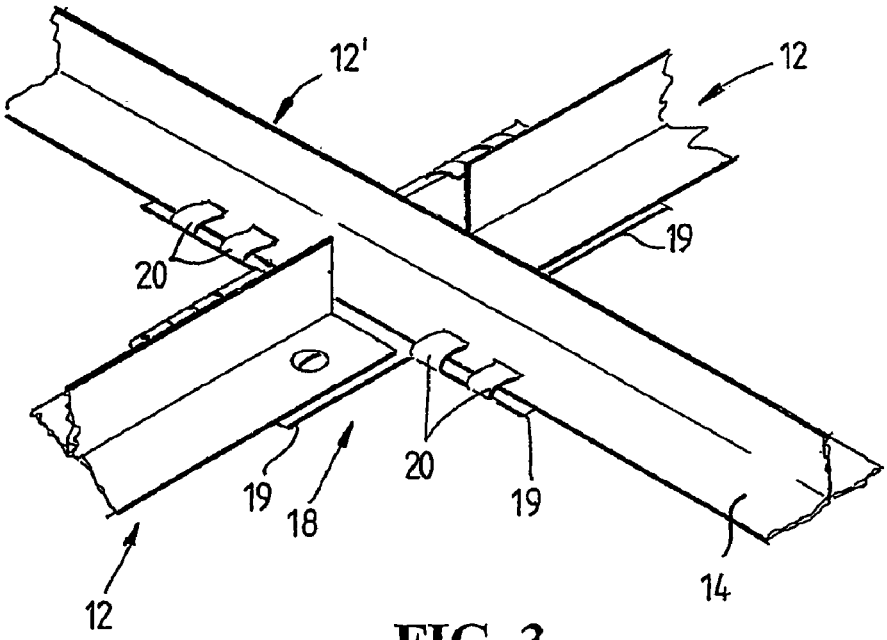
FIG. 3 is an enlarged perspective view of the region B of FIG. 1 showing the interconnection between crack promoting inserts used in the concrete slab.
Figure 4:
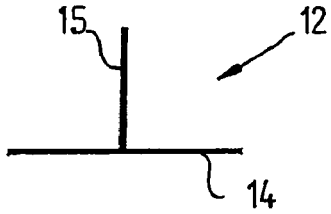
FIG. 4 illustrated in enlarged sectional view, the crack promoting inserts shown in FIG. 3.

The crack promoting inserts 12 as shown more clearly in FIGS. 3 and 4 are in this embodiment of a T-shaped configuration and include a planar base flange 14 and a central upright flange or leg 15. For construction of the slab 10, a series of crack promoting inserts 12 are provided with the base flanges 14 thereof being arranged to seat on the ground surface 13 (or membrane). The crack promoting inserts 12 are arranged such that a first set 16 of substantially parallel spaced apart crack promoting inserts 12 are arranged to extend substantially at right angles to a second set 17 of substantially parallel spaced apart crack promoting inserts 12. At the points of intersection between the crack promoting inserts 12 in each set 16 and 17, a plurality of connectors 18 are provided to hold the crack promoting inserts 12 in a stable attitude or the crack promoting inserts 12 interlock with each other as described further below.

Figure 5:
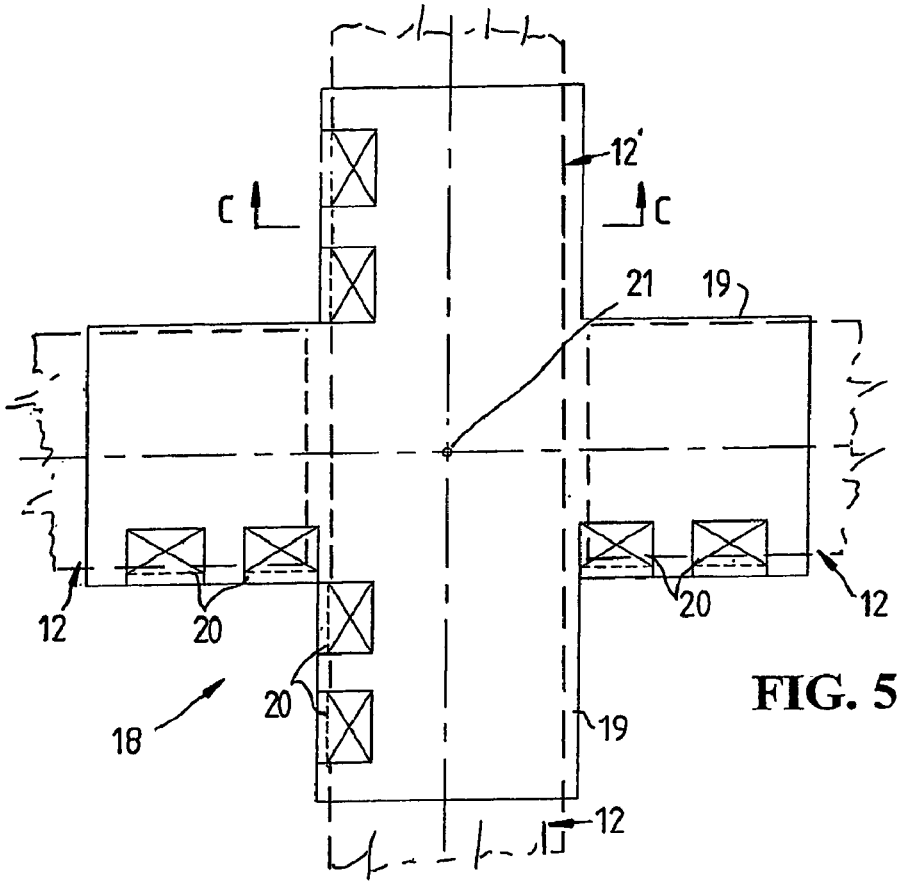
FIG. 5 illustrates in plan view a connector for connecting orthogonally arranged crack promoting inserts which are shown in dotted outline.
Figure 6:
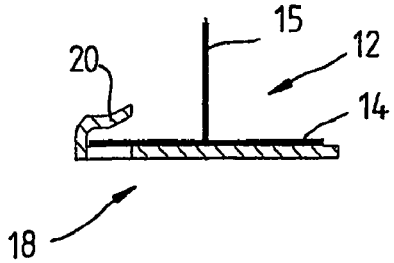
FIG. 6 is a sectional view along line C-C of FIG. 5.

The connectors 18 as shown in FIGS. 3 and 5 are of a substantially cruciform configuration in plan view and include four arms 19, each being arranged at right angles to an adjacent arm 19. The connectors 18 are substantially planar—apart from tongues 20 arranged along corresponding edges of each arm 19. The tongues 20 are displaced from the main plane of the connector 18 so that the base flanges 14 of the crack promoting inserts 12 can seat on the planar arms 19 of the connector 18 and locate under the tongues 20 in the manner shown in FIG. 6. One crack promoting insert indicated as 12' may extend uninterrupted to opposite sides of the connector 18 whilst the other crack promoting inserts 12 extending at right angles to the crack promoting insert 12' are supported on opposite arms 19 of the connector 18 and terminate at the connector 18 short of the crack promoting insert 12'. The opposing crack promoting inserts 12 are also held in position by the tongues 20 provided on the respective opposite arms 19. The tongues 20 may be such as to apply a resilient holding force to the crack promoting inserts 12 (and 12') to hold them firmly in position.

The connectors 18 may be held in position by means of fasteners driven through central holes 21 in the connectors 18 into a survey peg during initial setting up of the grid of inserts 12. The crack promoting inserts 12 and 12' may also be secured positively to the connectors 18 by fasteners driven through the base flanges 14 of the inserts 12 and 12'. The crack promoting inserts 12' instead of being uninterrupted may also be split into a pair of aligned inserts 12 which terminate at the connector 18. The inserts 12 may also be secured to the connectors 18 by other connection arrangements which do not extend beneath the connector 18 and into the underlying ground surface 13 (or membrane supported on the surface 13).

Figure 7:
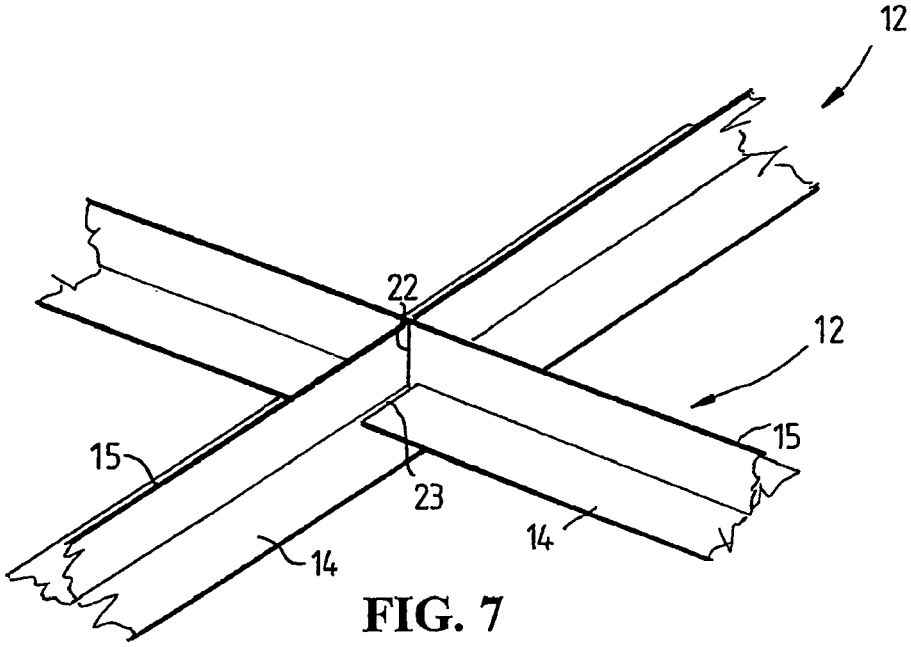
FIG. 7 illustrates an alternative connection between the crack promoting inserts in the region D of FIG. 1.
Figure 8:
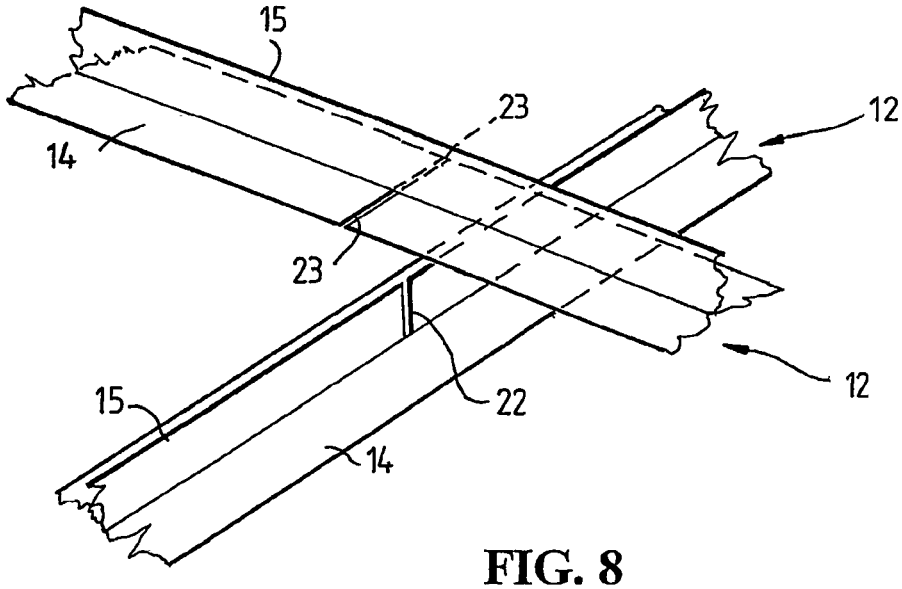
FIG. 8 is an exploded view showing the manner in which the crack promoting inserts are connected in the manner shown in FIG. 7.
Figure 9:
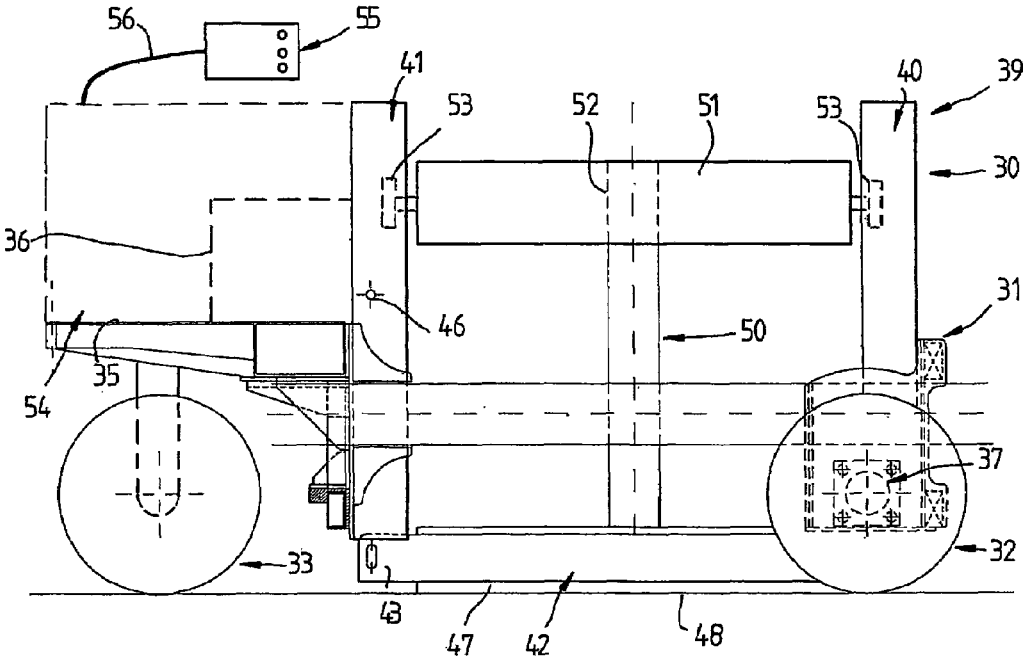
FIG. 9 illustrates in schematic side elevation, mobile impact applying apparatus for forming cracks in a concrete slab.
Figure 10:
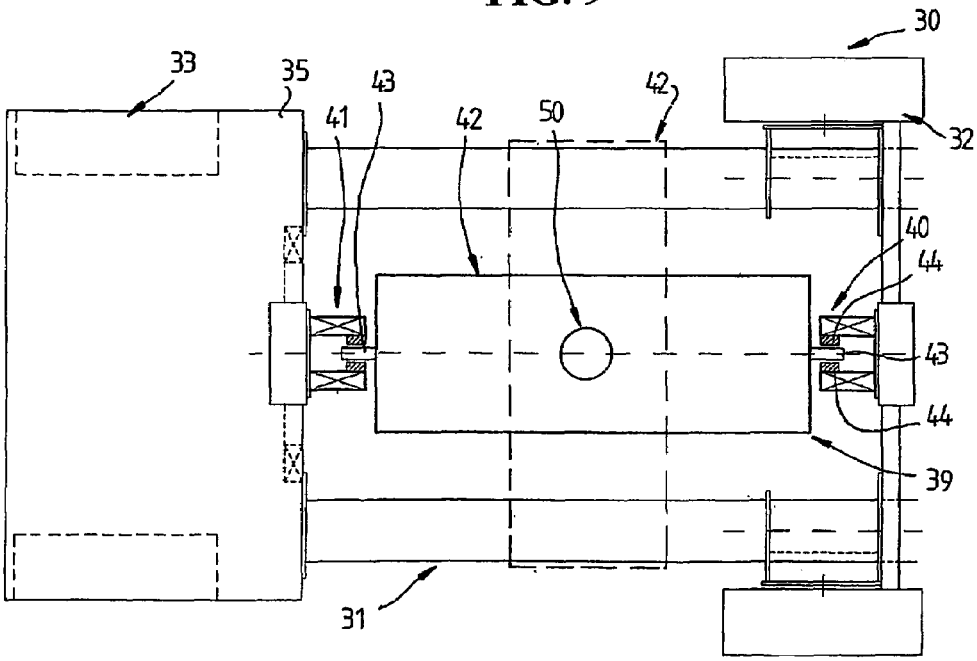
FIG. 10 is a plan view of the apparatus of FIG. 9 with the impact beam of the apparatus removed.
Figure 12:
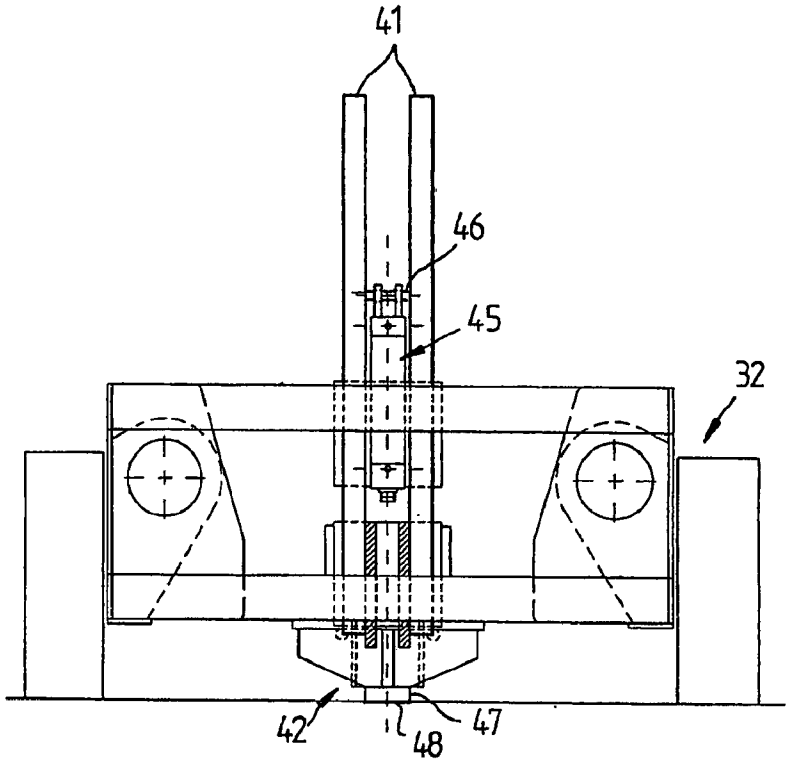
FIGS. 11 and 12 are front and rear elevations of the apparatus of FIG. 9.
Figure 11:
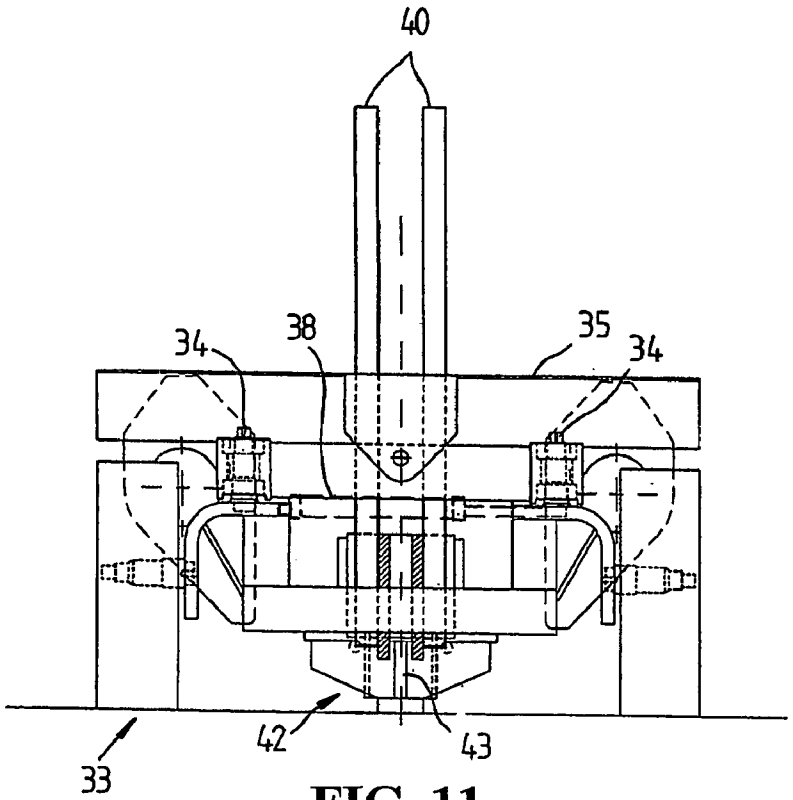

In an alternative arrangement for connecting crossing inserts 12 shown in the region D of FIG. 1 and illustrated in FIGS. 7 and 8, the upright flanges 15 are provided with a series of equally spaced slots 22 which extend at right angles to the base flange 14 and have a width slightly greater than the thickness of the upright flanges 15. The inserts 12 for another set of inserts 12 at right angles have a series of equally spaced slots 23 formed in their base flanges 14, the slots 23 also being of a width slightly greater than the thickness of the upright flanges 15 and extending at right angles to the upright flange 15. Thus one insert 12 placed above and extending at right angles to the other insert 12 may interlock with the other insert 12 in the manner shown in FIG. 7 with the upright flange 15 of the lower insert 12 being received in the slots 23 of the upper inert 12 and the slot 22 of the lower insert 12 receiving the upright flange 15 of the upper insert 12.

After the rectangular array or grid of crack promoting inserts 12 is established on the surface 13, reinforcing mesh or rods of any configuration may be positioned above the inserts 12, the reinforcing mesh or rods normally being supported on conventional chairs. Alternatively the concrete slab 10 may be constructed without the use of reinforcing or the concrete may be reinforced with fibres. The concrete pour then takes place so that the inserts 12 and connectors 18 and reinforcing mesh, rods or fibres where used are embedded within the formed slab 10.

After a suitable curing time, typically up to 168 hours but possibly up to 28 days after the concrete pour, an impact tool 24 is positioned on or above the upper surface 25 of the slab 10, the tool 24 including an elongated linear impact applying member or bolster 26. The member 26 is aligned longitudinally with, and substantially directly above, a crack promoting insert 12 of the array or grid of inserts 12. The tool 24 is then actuated to cause or permit the impact member 26 to apply an impact to the upper surface 25 of the concrete slab 10. The impact will create a crack 11 in the slab 10 substantially along the line of impact and extending from the crack promoting insert 12 as is more readily apparent in FIG. 2. The crack 11 typically will propagate a short distance beyond the opposite ends of the impact member 26. To establish a crack for the full width of the slab 12, the impact tool 24 is repositioned to place the impact member 26 as shown in dotted outline in FIG. 1 to a position in alignment with the previously created crack 11 and the tool 24 again actuated to form a further crack through the slab 10. This procedure is repeated across the width of the slab 10 so that a substantially continuous crack 11 is established the full width of the slab 10 and extending from the crack promoting insert or inserts 12. The impact tool 24 is then repositioned so as to be aligned with the next laterally positioned row of inserts 12 and again the impact applying procedure repeated.

For creating of cracks extending at right angles to the previously formed cracks 11, the tool 24 is again repositioned such as to the position E shown in dotted outline in FIG. 1 and the process repeated to create a second set of cracks 11 aligned with a further or further crack promoting insert/s 12. Thus the slab 10 after the impact applying process is provided with two sets of substantially continuous cracks 11 extending at right angles to each other and aligned with the respective crack promoting inserts 12 in the slab 10.

The tool 24 illustrated schematically in FIGS. 1 and 2 has an impact applying member 26 having a flat undersurface 27 which serves as the contact face of the tool 24, the face 27 being substantially broader than the width of the crack 11. The slab 10 may prior to use of the tool 24 be provided with grooves 28 aligned with the crack promoting inserts 12, the grooves 28 being formed by saw cuts in the slab 10 or being moulded into the slab 10 (see FIG. 2). The grooves 28 provide lines to which the cracks 11 propagate, the grooves 28 defining "clean" upper edges to the crack 11.

In an alternative arrangement, the tool 24 may include a bolster-type blade 29 as shown in FIG. 2 which when actuated provides a narrow line of impact against the slab surface 25. The blade 29 may be used in conjunction with a grooved slab and can be of a width such that it can locate within the groove 28.

Referring now to FIGS. 9 to 12, there is illustrated apparatus 30 for applying an impact to the surface 25 of the concrete slab 10 to form cracks 11 in the slab 10 in accordance with the above described method. The apparatus 30 is a self-powered apparatus and includes a mobile chassis 31 supported by a front pair of wheels 32 and a rear pair of wheels 33, the wheels 33 being steerable wheels and being mounted at 34 to the chassis 31 for pivotal movement about a substantially vertical axis so as to enable the apparatus 30 to be steered over a concrete slab 10 and to and from the concrete slab 10. A rear platform 35 is provided on the chassis 31 above the steerable wheels 33 and supports a power source 36 (shown in dotted outline in FIG. 9) comprising an internal combustion engine, typically a diesel engine coupled to an hydraulic pump for supply of hydraulic fluid to various hydraulic components of the apparatus 30. The hydraulic components include hydraulic motors 37 coupled to the wheels 32 for driving the apparatus 30 in opposite directions. The power source can also supply hydraulic fluid to a hydraulic linear actuator 38 (shown in dotted outline in FIG. 11) for pivoting the steerable wheels 33 about a vertical axis for steering of the apparatus 30.

Supported on the chassis 31 forwardly of the platform 35 is an impact head assembly 39. The assembly 39 includes a pair of laterally spaced apart upright front guides 40 and a corresponding pair of rear guides 41 aligned with the centreline of the apparatus 30. The guides 40 and 41 are fixed rigidly at their lower ends to the chassis 31 but may be mounted to a slide (not shown) which is arranged for slidable movement laterally of the chassis 31.

An elongated contact beam 42 extends between the guides 40 and 41 and includes opposite ends 43 which locate between the respective pairs of guides 40 and 41. The guides 40 and 41 are provided on their inner sides with opposing elongated rubbing strips 44 between which the ends 43 are guided. Hydraulic rams or actuators 45 (shown in FIG. 12) are provided between each pair of guides 40 and 41 and have their piston rods coupled to the opposite ends 43 of the beam 42 and their cylinders connected by pins 46 to the respective pairs of guides 40 and 41. Simultaneous extension and retraction of the actuators 45 will cause the contact beam 42 to be lowered and raised respectively. The contact beam 42 includes a narrow contact member 47, the member 47 having a substantially planar lower surface 48 which lies in a substantially horizontal plane. To prevent damage to the concrete of the slab 10 adjacent to the crack 11 formed in the slab 10 by the contact member 47, a strip 49 of resilient material such as a strip of rubber is adhered or otherwise affixed to the surface 48. This additionally accommodates irregularities in the surface 25 of the concrete slab 10.

A central vertical guide 50 is mounted to the contact beam 42 between the opposite front and rear guides 40 and 41 and extends upwardly therefrom, the guide 50 being adapted to guide movement of an impact beam 51, the guide 50 passing through an opening 52 provided centrally in the impact beam 51. A pair of horizontally axled rollers 53 are provided at opposite ends of the impact beam 51 and located between the front and rear guides 40 and 41 respectively. The impact beam 51 is thus maintained in longitudinal alignment with the contact beam 42. The impact beam 51 is weighted with suitable weights and when released from the raised position of FIG. 9, will fall under the influence of gravity to strike the contact beam 42. The guide 50 as described further below includes means for elevating the impact beam 51 to a position where it may be released to fall towards the contact beam 42.

The power source 36 and associated electrical and hydraulic controllers are housed in a housing 54 on the platform 35 (see FIG. 9) and the apparatus 30 is controlled by a remote control unit 55 connected through a cable 56 to the controllers within the housing 54. Alternatively, the remote control unit 55 comprises a wireless remote control unit which communicates through wireless communications with the controllers. The control unit 55 can control the application of hydraulic fluid to the drive motors 37 for the drive wheels 32 to control the forward and rear motion of the apparatus 30, to the steering actuator 38 to control the steering of the apparatus 30, to the elevating actuators 45 to control the position of the contact beam 42 and control the raising of, lowering of and release of the impact beam 51.

In operation, the apparatus 30 is driven under control of the remote control unit 55 onto a slab 10 such that the central longitudinal axis of the apparatus 30 is aligned with a previously installed crack promoting insert 12 in the slab 10. The actuators 45 are then actuated to lower the contact beam 42 and thus the contact member 47 into contact with the upper surface 25 of the slab 10. Usually the impact beam 51 is initially resting on the contact beam 42 and is lowered with the contact beam 42. After the contact beam 42 is seated on the concrete surface 25, the impact beam 51 is elevated to a position determined by the impact force to be applied to the contact beam 42. The impact beam 51 is then released to drop under the influence of gravity and strike the top side of the contact beam 42. This impact will be transferred through the contact member 47 to the surface 25 of the concrete slab 10 and cause a crack 11 to be produced within the slab 10 in the manner described above with the previously installed insert 12 ensuring that the crack 11 is propagated in a direction longitudinally of the insert 12 and through the slab 10.

The side actuators 45 may then be elevated to elevate the contact beam 42 and impact beam 51 which is now seated on the top side of the contact beam 42. The apparatus 30 is then advanced longitudinally by applying drive to the drive wheels 32 and the process described above then repeated so that a further crack 11 in longitudinal alignment with and joining the previously produced crack 11 is created. This procedure is repeated across the slab 10. At the opposite side of the slab 10, the apparatus 30 is repositioned in alignment with the adjacent crack promoting insert 12 or adjacent row of inserts 12 and the process repeated for the width of the slab 10 to produce a further crack extending across the slab 10. A series of cracks 11 are thus produced across the slab 10 and the apparatus 30 is repositioned and the process described above repeated to form the other cracks 11 in slab 10 where desired and as defined by the crack promoting inserts 12.

Figure 13:
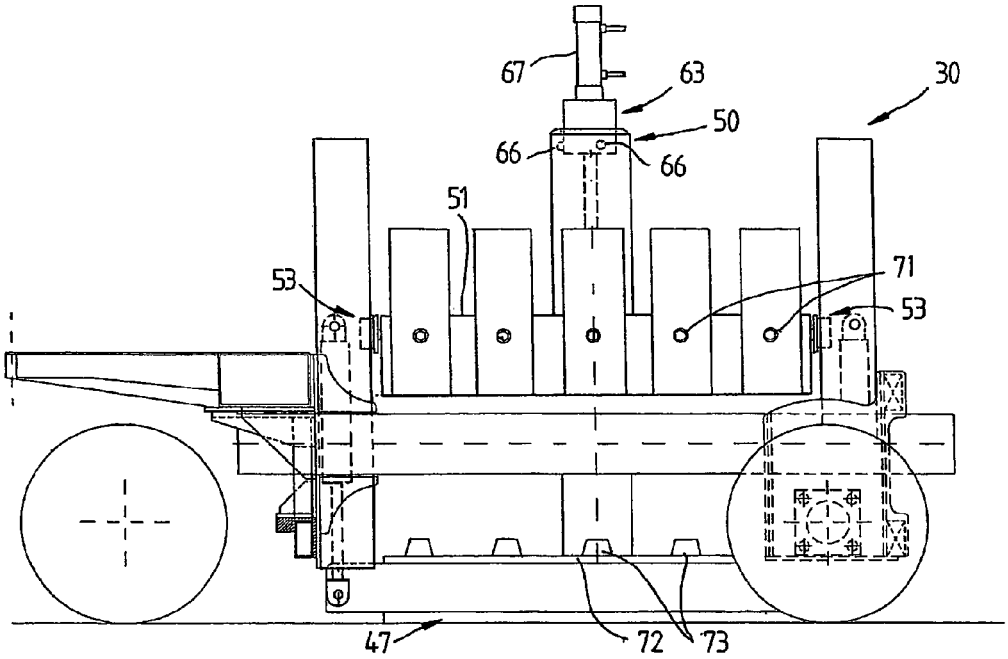
FIG. 13 is a detailed side view of the impact applying apparatus of FIG. 9 with the impact beam in a raised position.
Figure 14:
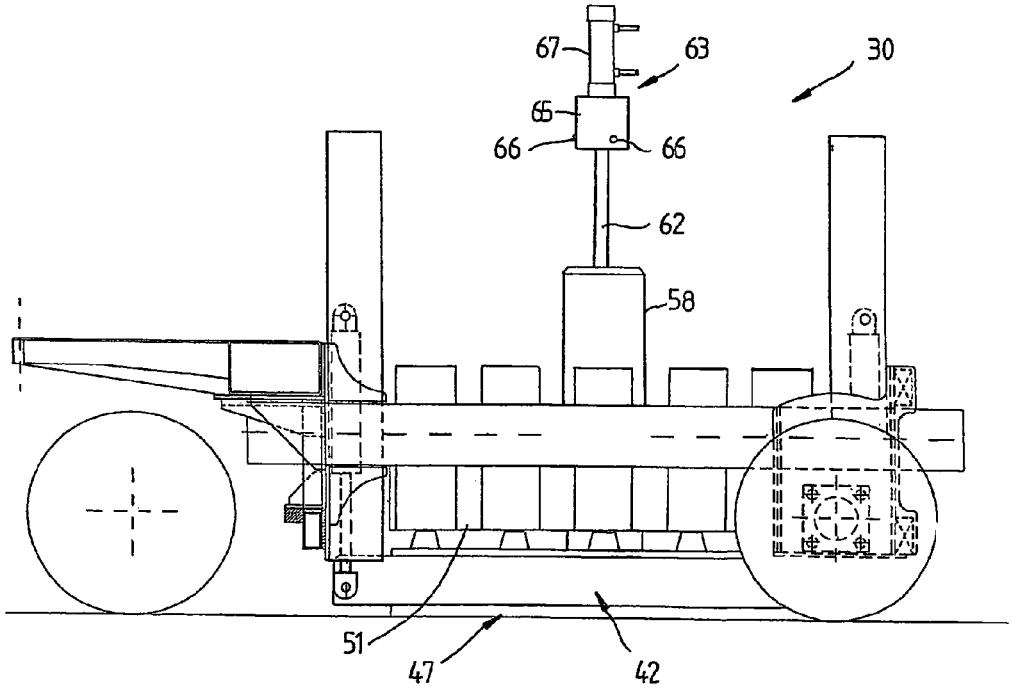
FIG. 14 is a further side view of the apparatus of FIG. 9 with the impact beam in a lowered position.
Figure 15:
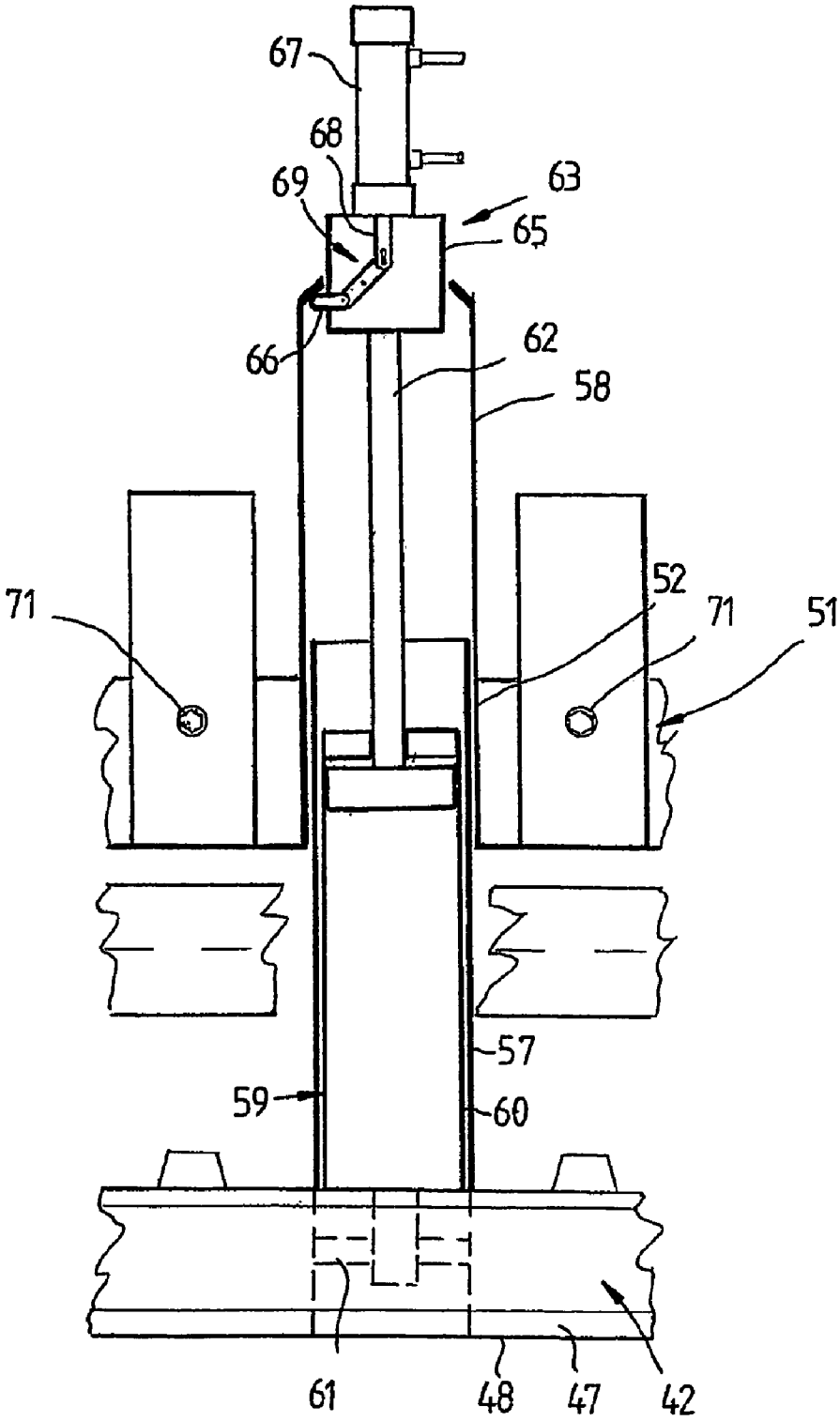
FIG. 15 is a cut away sectional view of the impact beam elevating and releasing mechanism of the impact applying apparatus.

Referring now to FIGS. 13 to 15, there is illustrated further details of the impact applying apparatus 30 of FIGS. 9 to 12 with the impact beam 51 in a raised and lowered position in FIGS. 13 and 14 respectively. The guide 50 for the impact beam 51 incorporates means for elevating and releasing the impact beam 51 and includes a first hollow cylindrical elongated inner part 57 which is fixed rigidly to the contact beam 42 to extend vertically upwardly from a central part of the contact beam 42 and a second hollow cylindrical outer part 58 which can telescopically receive the first part 57. The second part 58 of the guide 50 extends at its lower end into the bore 52 through the impact beam 51 and is rigidly secured to the impact beam 51 at this position for example by being welded to or bolted to the beam 51. The part 58 is located centrally longitudinally of the beam 51 so as to be aligned with the inner part 57.

Located coaxially within the telescopically engaged parts 57 and 58 is an hydraulic ram 59 adapted for elevating the impact beam 51. The ram 59 comprises a cylinder 60 which is located in the first inner part 57 and fixed at its lower end by a cross pin 61 extending transversely of and through the inner part 57. The piston rod 62 of the ram 59 extends from the cylinder 60 and is attachable to the outer sleeve part 58 through a releasable latch assembly 63 which is adapted to cooperate with an annular inwardly directed flange 64 fixed to or formed at the upper end of the sleeve part 58.

The latch assembly 63 includes a main cylindrical latch body 65 which is fixed to the upper end of the piston rod 62, the diameter of the latch body 65 being less than the inner diameter of the flange 64 such that it can extend into the upper end of the sleeve part 58 and beyond the flange 64. Mounted within the latch body 65 are a plurality of latch pins 66 (typically three) which are supported for movement radially of the latch body 65 between a position in which they extend partially out of the body 65 and a position where they are retracted substantially into the body 65. A hydraulic latch ram 67 is mounted to the latch body 65 to extend axially relative to the piston rod 62. The piston rod 68 of the latch ram 67 is linked through a linkage 69 to the latch pins 66 such that when the ram 67 is actuated in opposite directions, the latch pins 66 are either urged outwardly of the body 65 or retracted into the body 65.

When the latch body 65 is located within the end of the sleeve part 58 with the latch pins 66 extended, they will locate beneath the annular flange 64 as shown in FIG. 15 such that when the piston rod 62 of the ram 59 is extended, the sleeve part 58 and attached impact beam 51 are elevated with the latch body 65.

A series of weights 70 may be secured to the opposite sides of the impact beam 51 by bolts 71. The weights 70 may be secured to the beam 51 or removed from the beam 51 depending upon the impact to be applied to the tool. Unused weights 70 may be simply attached of the chassis 31 of the apparatus 30.

The contact beam 42 as well as incorporating the contact member 47 has an upper substantially horizontal plate 72 against which the impact beam 51 may act. The upper surface of the plate 72 may carry a series of spaced bumpers 73 formed at least partially of a resilient or cushioning material such as polypropylene, the bumpers 73 being in the path of movement of the beam 51 to cushion the impact of the beam 51.

In use, if the latch body 65 is not located within the upper end of the sleeve part 58, it is moved (with its latch pins 66 retracted) by the ram 59 under the control of the remote control unit 55 to a position with the end of the sleeve part 58 after which the latch ram 67 is actuated to extend the latch pins 66 onto the underside of the flange 64. The ram 59 is then actuated to extend the piston rod 62 and due to the cooperation between the latch pins 66 and flange 64, the sleeve part 58 and attached impact beam 51 will be elevated such as to the position of FIGS. 13 and 15.

When the impact is to be applied to the concrete slab 10, the latch ram 67 is actuated to retract the pins 66. The pins 66 will then be moved clear of the flange 64 which disconnects the piston rod 62 from the sleeve part 58. The sleeve part 58 and attached beam 51 will then be free to fall under the influence of gravity to impact against the contact beam 42 (or the bumpers 73) as shown in FIG. 14. This impact will be transferred through the contact member 47 to create a crack 11 in the concrete slab 10. The apparatus 30 may then be moved to further parts of the concrete slab 10 in the manner described above to create the further cracks 11 where desired.

The contact member 47 may have a planar undersurface 48 as described or may be in the form of a bolster or blade 29 as for example of the configuration shown in FIG. 2.

Figure 16:
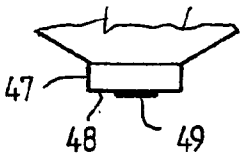
FIG. 16 is a sectional view of an alternative form of contact beam for use in the apparatus.

In an alternative arrangement shown in FIG. 16, the member 48 may comprise a combination of the planar surface 48 and a strip 49 of rubber or other resilient material of a width less than the width of the surface 48 and located centrally of the planar surface 48.

Figure 17:
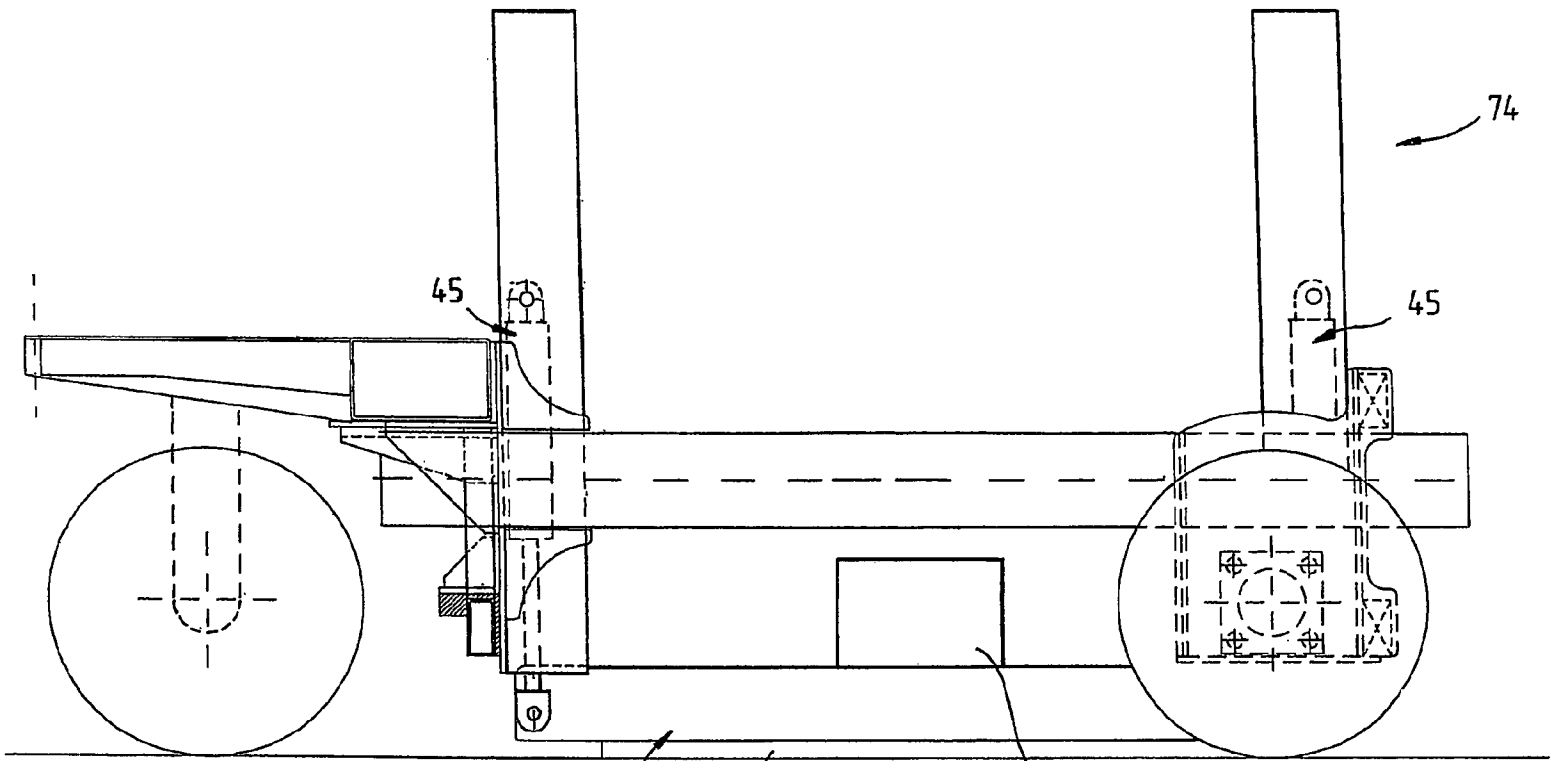
FIG. 17 is a side view of alternative crack forming apparatus for use in the method of the invention.

FIG. 17 illustrates an alternative apparatus 74 for use in the method of the invention, the apparatus 74 being similar in configuration to the apparatus of FIGS. 13 and 14 and having a contact beam 42 with a contact member 47 for contact with the concrete surface and a support chassis and steering arrangement similar to the apparatus 30. As above, hydraulic rams or actuators 45 as before are provided for elevating or lowering the contact beam 42. In this case however a vibratory force is generated by a mechanical (or fluid actuated) vibrator 75 which is mounted on the top side of the contact beam 42. Thus when the contact beam 42 is lowered so that the contact member 47 contacts the concrete surface 25 as in FIG. 17, the vibrator 75 is actuated to cause a vibratory force to be applied to the surface 25 through the member 47 to cause the propagation of a crack 11 in the concrete slab 10 along an insert 12 and/or groove 28 in the slab surface 25.

Figure 18:
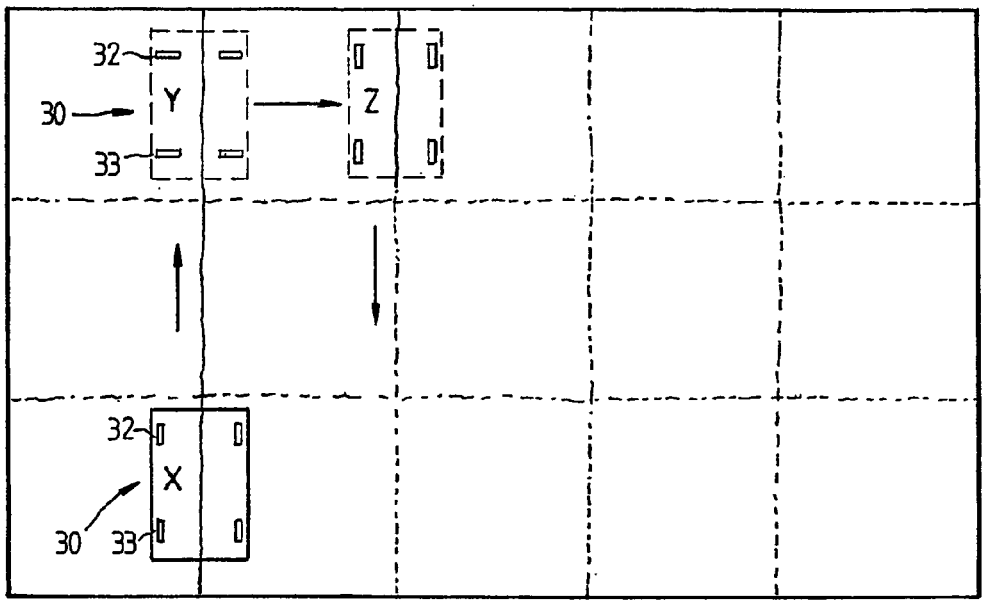
FIG. 18 is a plan view illustrating schematically the operation of the apparatus on a slab.

FIG. 18 illustrates typical movements of the impact applying apparatus 30 (or 74) over a slab 10 for formation of the grid of cracks 11. The apparatus 30 in this case has front and rear wheels 32 and 33 which can be pivoted at least 180 degrees. This permits the apparatus 30 to be driven forwardly from the position X in FIG. 18 to the position Y for formation of a first line of cracks 11 across the slab 10 in which case the wheels 22 and 23 are aligned with the longitudinal axis of the apparatus. At the position Y, the wheels 32 and 33 are pivoted 90 degrees which enables the apparatus 30 to be driven laterally to the position Z where the wheels 32 and 33 can be again pivoted back through 90 degrees for formation of the second line of cracks 11. The apparatus 30 can then be continued to be moved over the slab 10 for formation of the grid of cracks 11.

Figure 19:
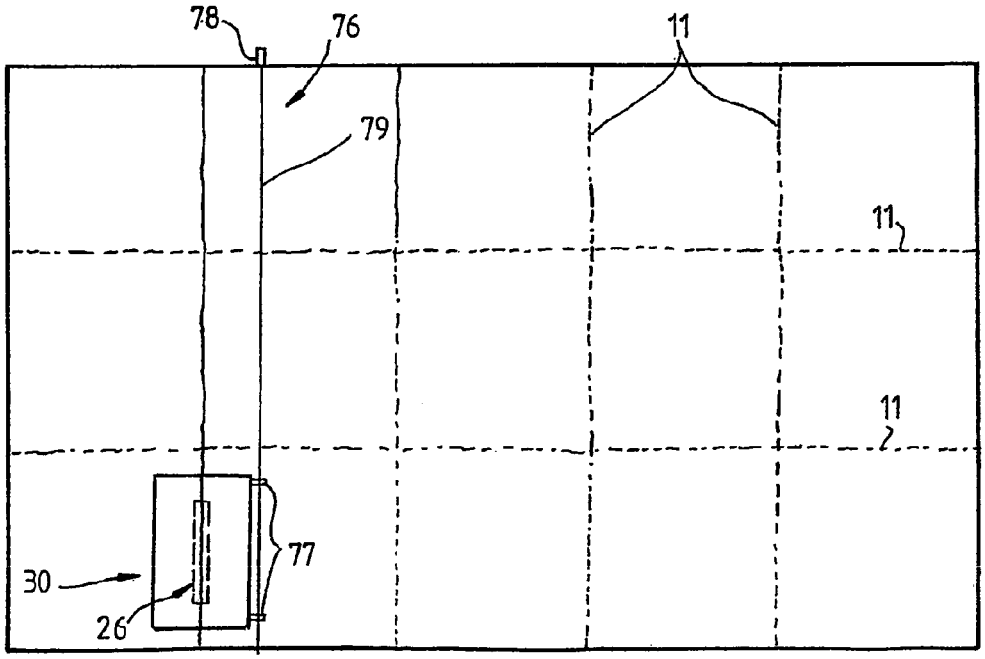
FIG. 19 illustrates the manner in which the apparatus may be automatically guided over a slab.

For faster more accurate alignment of the apparatus 30 above the crack promoting groove 28 and/or insert 12 and thereby more accurate creation of the cracks 11 within the slab, a laser guidance system 76 shown in FIG. 19 may be used to guide movement of the apparatus 30 over the slab 10. The apparatus 30 for this purpose is provided with forward and rear vertically offset laser receivers 77 on one side and using surveying techniques, a laser beam transmitter 78 is set up to establish a vertical laser plane 79 shown in FIG. 19 extending across the slab 10, the plane 79 being offset from but parallel to a row of inserts 12. The apparatus 30 may then be set in an automatic mode so that when the receivers 77 are aligned with the laser plane 79, the apparatus 30 will follow the plane 79 across the slab 10. Controllers will cause the apparatus 30 to move incrementally and further cause the actuation of the apparatus 30 to form the line of cracks 11 in vertical alignment with the inserts 12. At the opposite side of the slab 10, the laser transmitter 78 is repositioned for creation of the adjacent line of cracks 11 and similarly this procedure is repeated to form the remaining grid of cracks 11 in the slab 10.

Whilst particular embodiments of crack forming apparatus 30 and 74 have been described, it will be apparent that the crack forming apparatus may be in a number of different configurations. For example the contact beam 42 may extend transversely to the direction of movement of the apparatus as shown in dotted outline in FIG. 8. Similarly the crack promoting inserts 12 whilst shown in the embodiment to be of T-shaped configuration may be of any suitable configuration to promote the formation of cracks in the concrete article.

The terms "comprising" or "comprises" or derivatives thereof as used throughout the specification and claims are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as herein defined in the appended claims.

The invention claimed is:

1. A method of forming at least one crack in a concrete article comprising a concrete path, slab or pavement, said concrete article having an upper surface and at least one crack promoting insert cast within the concrete article beneath said upper surface, said method comprising the steps of:

positioning a tool having a force applying member on or above said upper surface of the concrete article whereby said member is located adjacent to or above said insert, and causing said tool to apply through said force applying member a force to said concrete article to promote the formation of a crack in said concrete article along and extending from a said insert.

2. A method as claimed in claim 1 wherein said force applying member comprises an elongated member.

3. A method as claimed in claim 2 wherein the length of the member is less than the length of said insert, and wherein said method includes the step of progressively moving the member to different locations longitudinally of the insert and applying a force to the concrete article at each location.

4. A method as claimed in claim 1 wherein said concrete article has a plurality of crack promoting inserts arranged in a grid and wherein said method includes the step of causing the force applying member to apply a force or forces to the concrete article to promote the formation of a plurality of cracks in the concrete article along the inserts in the grid.

5. A method as claimed in claim 4 wherein said inserts are arranged at right angles to each other to intersect each other and wherein said inserts interlock with each other at their points of intersection.

6. A method as claimed in claim 4 wherein said inserts are arranged at right angles to each other and including connectors for interconnecting said inserts.

7. A method as claimed in claim 1 wherein said concrete article has at least one crack promoting groove formed in said upper surface, said at least one crack promoting insert being substantially aligned with said at least one groove, and wherein said step of positioning said tool above the surface of the concrete article comprises the step of positioning said member adjacent to or above a groove, and wherein said step of applying a force to said concrete article promotes the formation of a crack in said concrete article along a said insert and between said insert and an aligned groove.

8. A method as claimed in claim 1 wherein said concrete article comprises a concrete path, pavement or slab with or without reinforcing.

9. A method as claimed claim 1 wherein said tool comprises an impact applying tool and wherein said force applying member comprises an impact applying member and wherein said step of applying a force to the concrete article comprises the step of applying an impact force through said impact applying member to the upper surface of said concrete article.

10. A method as claimed in claim 9 wherein said step of applying an impact force comprises the step of resting the impact member against the upper surface of said concrete article and applying an impact force to the impact member.

11. A method as claimed in claim 10 wherein said step of applying an impact force comprises means to elevate a weight and means for dropping the weight against said impact member.

12. A method as claimed in claim 9 wherein said step of applying an impact force to the concrete article comprises the step of striking the impact member directly against the article.

13. A method as claimed in claim 12 wherein said step of applying an impact force comprises means to elevate and drop the impact member against the concrete article.

14. A method as claimed in claim 1 wherein said tool comprises a vibrator for applying a vibratory force to said concrete article.

15. A method as claimed in claim 1 wherein said at least one insert has a "T" shaped configuration and is positioned in an inverted orientation in said concrete article.

16. Apparatus for forming at least one crack in a concrete article, said concrete article comprising a path, slab or pavement, said concrete article having an upper surface and at least one crack promoting insert cast within said concrete article beneath said upper surface, said apparatus including a chassis, said chassis supporting a tool having a force applying member, and means for causing said tool to apply through said member in use a force to said upper surface of said concrete article to promote the formation of a crack in said concrete article along and extending from a said crack promoting insert.

17. Apparatus as claimed in claim 16 wherein said chassis comprises a mobile chassis whereby said apparatus may be moved to different positions on the concrete article, said chassis supporting at least one pair of steerable wheels.

18. Apparatus as claimed in claim 17 wherein said chassis supports two pairs of steerable wheels, said wheels being steerable whereby said chassis may be moved laterally for repositioning said tool.

19. Apparatus as claimed in claim 16 wherein said tool comprises an elongated contact beam comprising the force applying member and means for applying a force to the contact beam.

20. Apparatus as claimed in claim 19 and including means for supporting said contact beam for movement between a first position where it is elevated in use above the upper surface of the concrete article and a second position where it is in contact with the upper surface of the concrete article.

21. Apparatus as claimed in claim 20 wherein said chassis supports guides for guiding the contact beam between its first and second positions.

22. Apparatus as claimed in claim 21 wherein said guides comprises guides at opposite ends of said contact beam and elevating and lowering means associated with each guide for elevating and lowering said contact beam.

23. Apparatus as claimed in claim 19 wherein said contact beam extends longitudinally or transversely of the chassis.

24. Apparatus as claimed in claim 19 wherein said tool comprises an impact tool and wherein said means for applying a force to said contact beam comprises a weighted member comprising an impact beam above said contact beam for applying an impact to said contact beam.

25. Apparatus as claimed in claim 24 and including means for elevating said impact beam above said contact beam and means for releasing said impact beam to permit said impact beam to drop under the influence of gravity towards said contact beam.

26. Apparatus as claimed in claim 25 wherein said impact beam comprises an elongated beam extending substantially parallel to said contact beam and means at opposite ends of said elongated beam for guiding said elongated beam towards and away from said contact beam.

27. Apparatus as claimed in claim 25 wherein said means for elevating said impact beam comprises a vertically extendable member and wherein said means for releasing said impact beam comprise releasable latching means for releasably latching said impact beam to said vertically extendable member.

28. Apparatus as claimed in claim 19 wherein said contact beam includes a planar contact member for contact with the upper surface of the concrete article, said planar contact member being provided with a strip of cushioning material.

29. Apparatus as claimed in claim 19 wherein said contact member comprises a blade-like member.

30. Apparatus as claimed in claim 16 wherein said tool comprises a vibrator for applying a vibratory force to said concrete article through said force applying member.

31. Apparatus according to claim 16 and including a laser guidance system for guiding movement of said apparatus over said concrete article, said laser guidance system including a laser beam transmitter for establishing a laser plane offset from and parallel to a row of inserts and laser receivers on the apparatus aligned with a longitudinal axis of said apparatus and adapted to be aligned with said laser plane.

32. A method of forming at least one crack in a concrete article having at least one crack promoting insert cast within the concrete article, said method comprising the steps of:

providing an impact applying tool having an impact applying member and a weight, resting said impact member on the surface of the concrete article such that said impact member is located adjacent to or above said insert, elevating said weight, and dropping said elevated weight against said impact applying member to cause an impact force to be applied to said impact applying member and thereby to said concrete article to promote the formation of a crack in said concrete article along a said insert.

33. A method of forming at least one crack in a concrete article having at least one crack promoting insert cast within the concrete article, said method comprising the steps of:

positioning an impact applying tool having an impact applying member above the surface of the concrete article whereby said member is located adjacent to or above said insert, and elevating said impact applying member and dropping said impact applying member to cause said impact applying member to directly strike and apply an impact force to said concrete article to promote the formation of a crack in said concrete article along a said insert.

34. Apparatus for forming at leat one crack in a concrete article provided with at least one crack promoting insert cast therein, said apparatus including a chassis, said chassis supporting a tool having a force applying member comprising an elongated contact beam, means for supporting said contact beam for movement between a first position where it is elevated in use above the surface of the concrete article and a second position where it is in contact with the surface of the concrete article, and means for applying a force to said elongated contact beam such that wherein said contact beam is in said second position, a force is applied to said concrete article to promote the formation of a crack in said concrete article along a said crack promoting insert.

35. Apparatus as claimed in claim 34 wherein said chassis supports guides for guiding the contact beam between its first and second positions.

36. Apparatus as claimed in claim 35 wherein said guides comprises guides at opposite ends of said contact beam and elevating and lowering means associated with each guide for elevating and lowering said contact beam.

37. Apparatus for forming at least one crack in a concrete article provided with at least one crack promoting insert cast therein, said apparatus including a chassis, said chassis supporting a tool having a force applying member, said force applying member comprising an elongated contact beam extending longitudinally or transversely of said chassis, and means for applying a force to said contact beam to thereby cause said contact beam to apply a force to said concrete article to promote the formation of a crack in said concrete article along a said crack promoting insert.

38. Apparatus for forming at least one crack in a concrete article provided with at least one crack promoting insert cast therein, said apparatus including a chassis, said chassis supporting an impact tool having a force applying member comprising an elongated contact beam and a weighted member comprising an impact beam extending substantially parallel to said contact beam and positioned above said contact beam for applying an impact to said contact beam, means at opposite ends of said elongated beam for guiding said elongated beam towards and away from said contact beam, means for elevating said impact beam above said contact beam and means for releasing said impact beam to permit said impact beam to drop under the influence of gravity towards said contact beam to apply a force to said contact beam and thereby a force to said concrete article when said contact beam is in contact with said concrete article to promote the formation of a crack in said concrete article along a said crack promoting insert.

39. Apparatus for forming at least one crack in a concrete article provided with at least one crack promoting insert cast therein, said apparatus including a chassis, said chassis supporting an impact tool having a force applying member comprising an elongated contact beam and a weighted member comprising an impact beam positioned above said contact beam for applying an impact to said contact beam, a vertically extendable member for elevating said impact beam above said contact beam, releasable latching means for releasably latching said impact beam to said vertically extendable member, said latching means being releasable to release said impact beam and permit said impact beam to drop under the influence of gravity towards said contact beam to applying a force to said contact beam and thereby enable a force to be applied to said concrete article to promote the formation of a crack in said concrete article along a said crack promoting insert.

* * * * *